US006439790B1

(12) United States Patent
Kay

(10) Patent No.: US 6,439,790 B1
(45) Date of Patent: Aug. 27, 2002

(54) SOAP BRUSH

(76) Inventor: Sam Kay, 15432 Electronic La., Huntington Beach, CA (US) 92649

( * ) Notice: Subject to any disclaimer, the term of this patent is extended or adjusted under 35 U.S.C. 154(b) by 0 days.

(21) Appl. No.: 09/865,356

(22) Filed: May 25, 2001

(51) Int. Cl.[7] ..... A46B 11/04
(52) U.S. Cl. ..... 401/149; 401/279; 401/281
(58) Field of Search ..... 401/6, 149, 146, 401/275, 279, 281, 280, 287

(56) References Cited

U.S. PATENT DOCUMENTS 2,736,914 A * 3/1956 Ratliff ..... 401/281
3,271,809 A * 9/1966 Morawski ..... 401/281 X
3,544,226 A 12/1970 Kellis
4,229,116 A 10/1980 Moore
4,875,791 A 10/1989 Hassan
D313,123 S 12/1990 Hayes
5,211,494 A 5/1993 Baijnath
5,758,984 A 6/1998 Doherty

* cited by examiner

*Primary Examiner*—Gregory Huson
*Assistant Examiner*—Kathleen J. Prunner

(57) ABSTRACT

A brush is provided for allowing a user to dispense liquid soap on the head of a brush member to aid in the cleaning of a surface. The soap brush includes a housing that has a head portion and a handle portion extending from the head portion. The housing is for holding a supply of the liquid soap. The head portion is structured to include a soap dispensing hole. The brush member is coupled to the head portion of the housing. A soap release assembly disposed in the head portion is movable between an open position and a closed position. The open position permits release of the liquid soap through the soap dispensing hole of the head portion.

12 Claims, 2 Drawing Sheets

SOAP BRUSH

BACKGROUND OF THE INVENTION

1. Field of the Invention

The present invention relates to soap brush assemblies and more particularly pertains to a new soap brush for allowing a user to dispense liquid soap on the head of a brush to aid in the cleaning of a surface.

2. Description of the Prior Art

The use of soap brush assemblies is known in the prior art. More specifically, soap brush assemblies heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,229,116; 5,211,494; U.S. Pat. No. Des. 313,123; U.S. Pat. Nos. 3,544,226; 5,758,984; and 4,785,791.

While these devices fulfill their respective, particular objectives and requirements, the aforementioned patents do not disclose a new soap brush. The inventive device includes a housing that has a head portion and a handle portion extending from the head portion. The housing is adapted for holding liquid soap. The head portion is structured to include a soap dispensing hole. A brush member is coupled to the head portion of the housing. The soap release assembly is movable between an open position and a closed position. The open position is for permitting release of the liquid soap through the soap dispensing hole of the head portion.

In these respects, the soap brush according to the present invention substantially departs from the conventional concepts and designs of the prior art, and in so doing provides an apparatus primarily developed for the purpose of allowing a user to dispense liquid soap on the head of a brush member to aid in the cleaning of a surface.

SUMMARY OF THE INVENTION

In view of the foregoing disadvantages inherent in the known types of soap brush assemblies now present in the prior art, the, present invention provides a new soap brush construction wherein the same can be utilized for allowing a user to dispense liquid soap on the head of a brush member to aid in the cleaning of a surface.

The general purpose of the present invention, which will be described subsequently in greater detail, is to provide a new soap brush apparatus and method which has many of the advantages of the soap brush assemblies mentioned heretofore and many novel features that result in a new soap brush which is not anticipated, rendered obvious, suggested, or even implied by any of the prior art soap brush assemblies, either alone or in any combination thereof.

To attain this, the present invention generally includes a housing that has a head portion and a handle portion extending from the head portion. The housing is adapted for holding liquid soap. The head portion is structured to include a soap dispensing hole. A brush member is coupled to the head portion of the housing. The soap release assembly is movable between an open position and a closed position. The open position is for permitting release of the liquid soap through the soap dispensing hole of the head portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new soap brush apparatus and method which has many of the advantages of the soap brush assemblies mentioned heretofore and many novel features that result in a new soap brush which is not anticipated, rendered obvious, suggested, or even implied by any of the prior art soap brush assemblies, either alone or in any combination thereof.

It is another object of the present invention to provide a new soap brush, which may be easily and efficiently manufactured and marketed.

It is a further object of the present invention to provide a new soap brush, which is of a durable and reliable construction.

An even further object of the present invention is to provide a new soap brush which is susceptible of a low cost of manufacture with regard to both materials and labor, and which accordingly is then susceptible of low prices of sale to the consuming public, thereby making such soap brush economically available to the buying public.

Still yet another object of the present invention is to provide a new soap brush, which provides in the apparatuses and methods of the prior art some of the advantages thereof, while simultaneously overcoming some of the disadvantages normally associated therewith.

Still another object of the present invention is to provide a new soap brush for allowing a user to dispense liquid soap on the head of a brush member to aid in the cleaning of a surface.

Yet another object of the present invention is to provide a new soap brush, which includes a housing that has a head portion and a handle portion extending from the head portion. The housing is adapted for holding liquid soap. The head portion is structured to include a soap dispensing hole. A brush member is coupled to the head portion of the housing. The soap release assembly is movable between an open position and a closed position. The open position is for permitting release of the liquid soap through the soap dispensing hole of the head portion.

Still yet another object of the present invention is to provide a new soap brush that would eliminate the hassle of searching through a bathtub full of water for a conventional bar of soap. It would also prevent a person from slipping on a conventional bar of soap, which would serve as an added safety feature.

Even still another object of the present invention is to provide a new soap brush that would allow a user to thoroughly cleanse his body without wasting soap.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
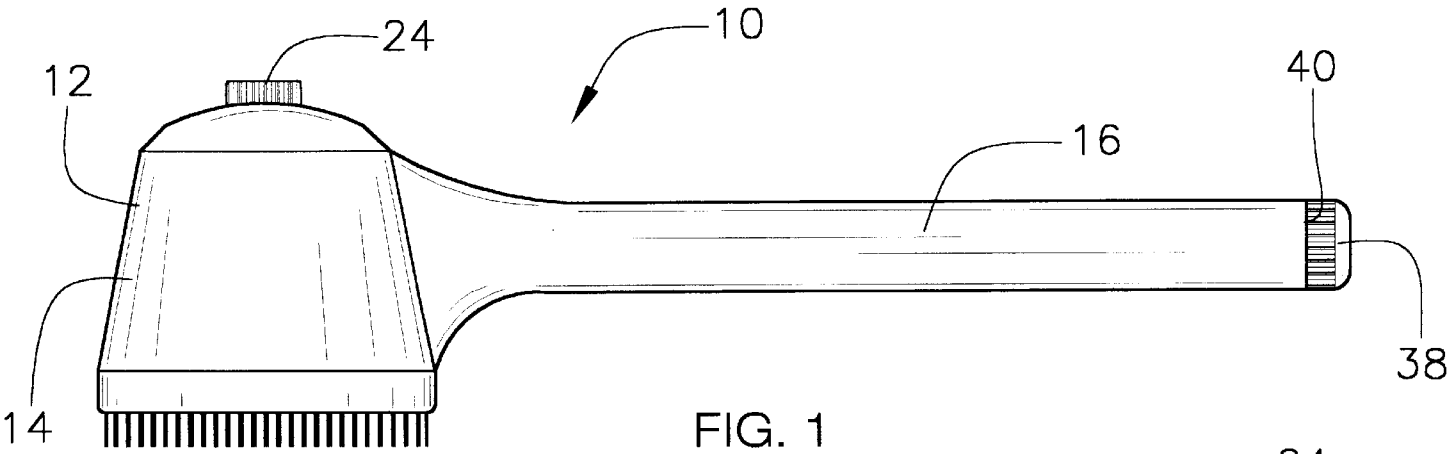
FIG. 1 is a side view of a new soap brush according to the present invention.
Figure 2:
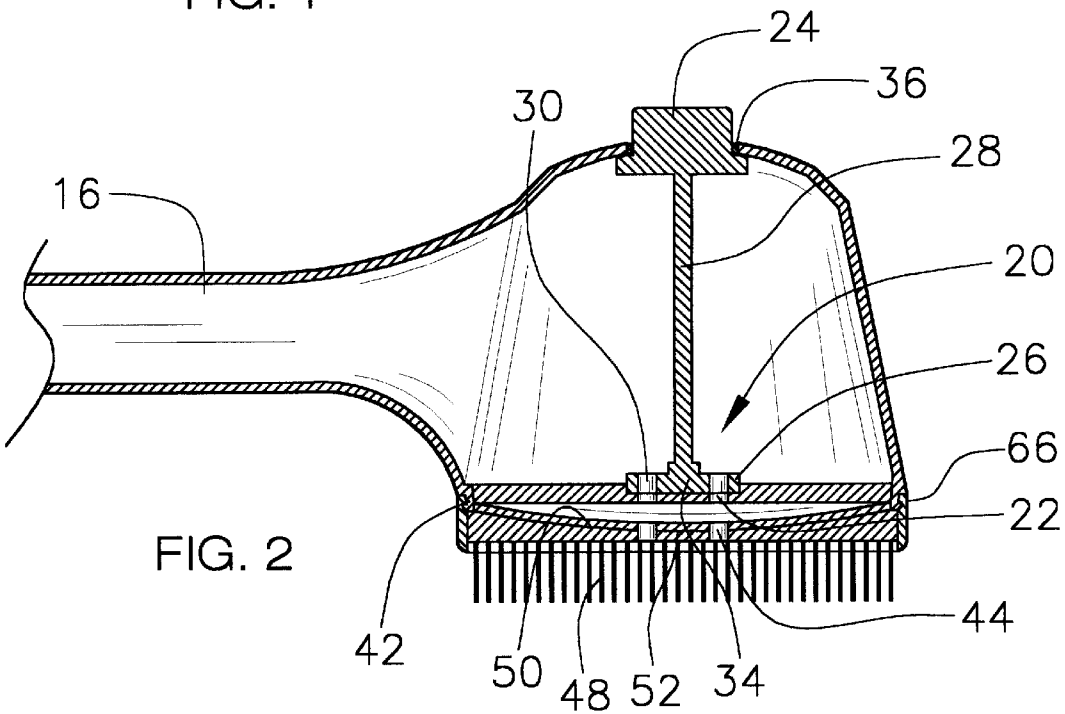
FIG. 2 is a cross-sectional view of the head portion of the present invention.
Figure 3:
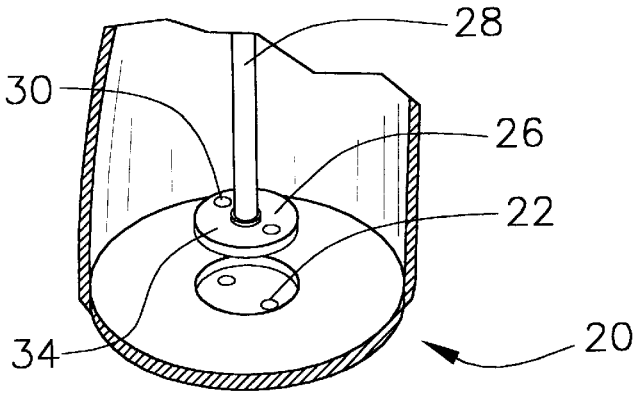
FIG. 3 is a perspective view of the head portion of the present invention.
Figure 4:
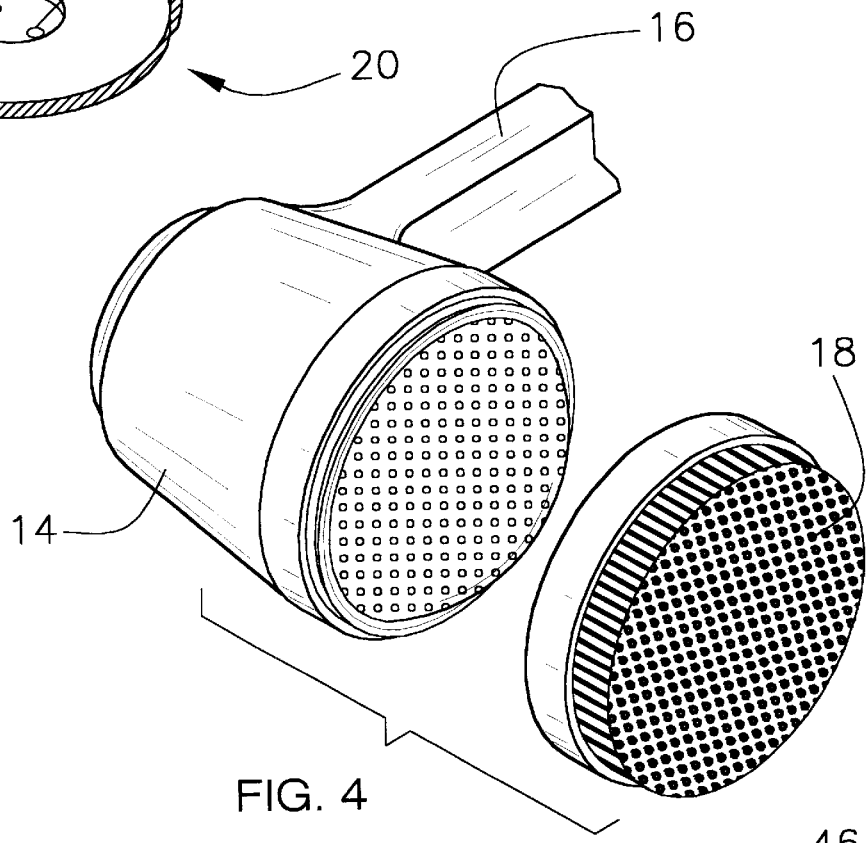
FIG. 4 is a perspective view of the head portion of the present invention.
Figure 5:
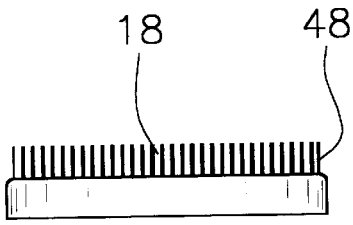
FIG. 5 is a side view of an embodiment of a brush member usable in the present invention.
Figure 6:
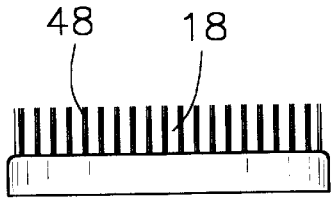
FIG. 6 is a side view of an embodiment of a brush member usable in the present invention.
Figure 7:
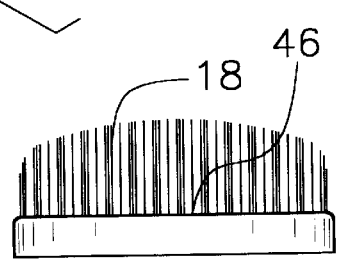
FIG. 7 is a side view of an embodiment of a brush member usable in the present invention.

With reference now to the drawings, and in particular to FIGS. 1 through 5 thereof, a new soap brush embodying the principles and concepts of the present invention and generally designated by the reference numeral 10 will be described.

As best illustrated in FIGS. 1 through 5, the soap brush 10 generally includes a housing 12 that has a head portion 14 and a handle portion 16 extending from the head portion 14. The housing 12 is adapted for holding liquid soap. The head portion 14 is structured to include a soap dispensing hole. A brush member 18 is coupled to the head portion 14 of the housing 12. The soap release assembly 20 is movable between an open position and a closed position. The open position is for permitting release of the liquid soap through the soap dispensing hole 22 of the head portion 14.

The soap release assembly 20 includes an actuation portion 24, a plate portion 26 and an axle portion 28. The axle portion 28 is for extending between the actuation portion 24 and the plate portion 26. The plate portion 26 is structured to include a dispensing aperture 30. The plate portion 26 is positioned adjacent to the dispensing hole 22 of the head portion 14. The dispensing aperture 30 of the plate portion 26 is alignable with the dispensing hole 22 of the head portion 14 for permitting release of the liquid soap through the dispensing hole 22. The plate portion 26 includes an obstruction portion 34. The obstruction portion 34 is alignable with the dispensing aperture 30 for preventing dispensing of the liquid soap through the dispensing aperture 30.

The actuation portion 24 of the soap release assembly 20 extends through the actuator opening 36 for facilitating access to the actuation portion 24. The actuation portion 24 is rotatable for moving the soap release assembly 20 between the open position and the closed position.

The dispensing hole 22 of the head portion 14 is positioned in a wall of the housing 12. The wall of the housing 12 includes an indentation surrounding the dispensing hole 22. The plate portion 26 is positioned in the indentation for preventing lateral movement of the plate portion 26 relative to the dispensing hole 22. An end cap 38 is positioned at a distal end 40 of the handle portion 16. The end cap 38 is removably coupled to the handle portion 16 for allowing liquid soap to be contained in the housing 12. The head portion 14 has a threaded brush connection portion 42 that extends from head portion 14.

The brush member 18 has a threaded perimeter wall 66 engageable to the threaded brush connection portion 42 for removably coupling the brush member 18 to the housing 12. The brush member 18 has a plurality of openings 44 positioned proximate a center of the brush member 18 for facilitating flow of the liquid soap through the openings 44 to an exterior surface 46 of the brush member 18. The brush member 18 has bristles 48 on the exterior surface 46. The bristles 48 extend from the exterior surface 46 of the brush member 18 such that the brush member 18 is adapted for facilitating the scrubbing of a surface to be cleaned. An upper surface 50 of the brush member 18 is concave, each of the openings 44 in the brush member 18 is positioned proximate a nadir 52 of the upper surface 50 for facilitating dispersal of the liquid soap through the openings 44 in the brush member 18 when the brush member 18 is in a horizontal position such that the bristles 48 are facing downward.

In use, a user would rotate the dial in one direction to dispense soap on the head of the brush, and rotate the dial in the other direction to stop the soap from being dispensed. The user would use the brush in the same manner as a conventional brush to clean a surface.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A soap brush assembly comprising:

a housing, said housing having a head portion and a handle portion extending from said head portion, said housing being adapted for holding liquid soap;

said head portion being structured to include a soap dispensing hole;

a brush member, said brush member being coupled to said head portion of said housing;

a soap release assembly, said soap release assembly being coupled to said housing, said soap release assembly being movable between an open position and a closed position, said open position being adapted to permit release of the liquid soap through said soap dispensing hole of said head portion;

said brush member having a plurality of openings positioned proximate a center of said brush member for facilitating flow of the liquid soap through said openings to an exterior surface of said brush member; and an upper surface of said brush member being concave, each of said openings in said brush member being positioned proximate a nadir of said upper surface for facilitating dispersal of the liquid soap through said openings in said brush member when said brush member is in a horizontal position with said bristles facing downward.

2. The soap brush assembly of claim 1, further comprising:

said soap release assembly including an actuation portion, a plate portion and an axle portion, said axle portion extending between said actuation portion and said plate portion;

said plate portion being structured to include a dispensing aperture;

said plate portion being positioned adjacent to said dispensing hole of said head portion, said dispensing aperture of said plate portion being alignable with said dispensing hole of said head portion for permitting release of the liquid soap through said dispensing hole.

3. The soap brush assembly of claim 2, further comprising:

said plate portion including an obstruction portion, said obstruction portion being alignable with said dispensing aperture for preventing dispensing of the liquid soap through said dispensing aperture.

4. The soap brush assembly of claim 2, further comprising:

said housing including an actuator opening;

said actuation portion of said soap release assembly extending through said actuator opening for facilitating access to said actuation portion; and said actuation portion being rotatable for moving said soap release assembly between said open position and said closed position.

5. The soap brush assembly of claim 1, further comprising:

said brush member being one of a plurality of interchangeable brush members, each of said brush members having a plurality of bristles, each of said brush members having a unique configuration of bristles.

6. A soap brush assembly comprising:

a housing, said housing having a head portion and a handle portion extending from said head portion, said housing being adapted for holding liquid soap;

said head portion being structured to include a soap dispensing hole;

a brush member, said brush member being coupled to said head portion of said housing;

a soap release assembly, said soap release assembly being coupled to said housing, said soap release assembly being movable between an open position and a closed position, said open position being adapted to permit release of the liquid soap through said soap dispensing hole of said head portion;

said soap release assembly including an actuation portion, a plate portion and an axle portion, said axle portion extending between said actuation portion and said plate portion;

said plate portion being structured to include a dispensing aperture;

said plate portion being positioned adjacent to said dispensing hole of said head portion, said dispensing aperture of said plate portion being alignable with said dispensing hole of said head portion for permitting release of the liquid soap through said dispensing hole;

said dispensing hole of said head portion being positioned in a wall of said housing;

said wall of said housing including an indentation surrounding said dispensing hole; and said plate portion being positioned in said indentation for preventing lateral movement of said plate portion relative to said dispensing hole.

7. The soap brush assembly of claim 6, further comprising:

an end cap, said end cap being positioned at a distal end of said handle portion; and said end cap being removably coupled to said handle portion for allowing liquid soap to be contained in said housing.

8. The soap brush assembly of claim 7, further comprising:

said head portion having a threaded brush connection portion extending from head portion; and said brush member having a threaded perimeter wall engageable to said threaded brush connection portion for removably coupling said brush member to said housing.

9. The soap brush assembly of claim 6, further comprising:

said brush member having a plurality of openings positioned proximate a center of said brush member for facilitating flow of the liquid soap through said openings to an exterior surface of said brush member.

10. The soap brush assembly of claim 9, further comprising:

said brush member having bristles on said exterior surface;

said bristles extending from said exterior surface of said brush member such that said brush member is adapted for facilitating scrubbing a surface to be cleaned.

11. A soap brush assembly comprising:

a housing, said housing having a head portion and a handle portion extending from said head portion, said housing being adapted for holding liquid soap;

said head portion being structured to include a soap dispensing hole;

a brush member, said brush member being coupled to said head portion of said housing;

a soap release assembly, said soap release assembly being coupled to said housing, said soap release assembly being movable between an open position and a closed position, said open position being adapted to permit release of the liquid soap through said soap dispensing hole of said head portion;

said soap release assembly including an actuation portion, a plate portion and an axle portion, said axle portion extending between said actuation portion and said plate portion;

said plate portion being structured to include a dispensing aperture;

said plate portion being positioned adjacent to said dispensing hole of said head portion, said dispensing aperture of said plate portion being alignable with said dispensing hole of said head portion for permitting release of the liquid soap through said dispensing hole;

said plate portion including an obstruction portion, said obstruction portion being alignable with said dispensing aperture for preventing dispensing of the liquid soap through said dispensing aperture;

said housing including an actuator opening;

said actuation portion of said soap release assembly extending through said actuator opening for facilitating access to said actuation portion;

said actuation portion being rotatable for moving said soap release assembly between said open position and said closed position;

said dispensing hole of said head portion being positioned in a wall of said housing;

said wall of said housing including an indentation surrounding said dispensing hole;

said plate portion being positioned in said indentation for preventing lateral movement of said plate portion relative to said dispensing hole;

an end cap, said end cap being positioned at a distal end of said handle portion;

said end cap being removably coupled to said handle portion for allowing liquid soap to be contained in said housing;

said head portion having a threaded brush connection portion extending from head portion;

said brush member having a threaded perimeter wall engageable to said threaded brush connection portion for removably coupling said brush member to said housing;

said brush member having a plurality of openings positioned proximate a center of said brush member for facilitating flow of the liquid soap through said openings to an exterior surface of said brush member;

said brush member having bristles on said exterior surface;

said bristles extending from said exterior surface of said brush member such that said brush member is adapted for facilitating scrubbing a surface to be cleaned; and an upper surface of said brush member being concave, each of said openings in said brush member being positioned proximate a nadir of said upper surface for facilitating dispersal of the liquid soap through said openings in said brush member when said brush member is in a horizontal position with said bristles facing downward.

12. The soap brush assembly of claim 11, further comprising:

said brush member being one of a plurality of interchangeable brush members, each of said brush members having a unique configuration of bristles.

* * * * *